US008205603B2

(12) United States Patent
Johnson

(10) Patent No.: US 8,205,603 B2
(45) Date of Patent: Jun. 26, 2012

(54) METHOD AND APPARATUS FOR REDUCING BLOW-BY COKING

(75) Inventor: Randall L. Johnson, Monee, IL (US)

(73) Assignee: International Engine Intellectual Property, LLC, Lisle, IL (US)

( * ) Notice: Subject to any disclaimer, the term of this patent is extended or adjusted under 35 U.S.C. 154(b) by 487 days.

(21) Appl. No.: 12/533,317

(22) Filed: Jul. 31, 2009

(65) Prior Publication Data

US 2011/0023851 A1 Feb. 3, 2011

(51) Int. Cl.
*F02M 25/02* (2006.01)

(52) U.S. Cl. ..... 123/572

(58) Field of Classification Search ..... 123/572–574
See application file for complete search history.

(56) References Cited

U.S. PATENT DOCUMENTS

| | | | | |
|---|---|---|---|---|
| 3,266,474 | A * | 8/1966 | Crandall | 123/543 |
| 4,342,287 | A * | 8/1982 | Concepcion | 123/1 A |
| 5,937,837 | A * | 8/1999 | Shaffer et al. | 123/573 |
| 6,044,829 | A * | 4/2000 | Butz et al. | 123/573 |
| 6,691,687 | B1 * | 2/2004 | Liang et al. | 123/572 |
| 2007/0251235 | A1 * | 11/2007 | Schmid et al. | 60/605.2 |

* cited by examiner

*Primary Examiner* — M. McMahon
(74) *Attorney, Agent, or Firm* — Mark C. Bach; Jeffrey P. Calfa

(57) ABSTRACT

A method of coking entrained oil from blow-by gas (F) of an engine (14) in a closed breather assembly (16) includes the steps of transporting the blow-by gas from the engine to a mist separator (18), transporting the blow-by gas from the mist separator to a breather coking device (12), heating the breather coking device at least one of conductively and convectively with an exhaust manifold (32) of the engine, coking out at least a portion of entrained oil from the blow-by gas and depositing the coked oil at the breather coking device, and transporting the blow-by gas from the breather coking device to one of a turbocharger compressor (24) and the engine.

13 Claims, 2 Drawing Sheets

METHOD AND APPARATUS FOR REDUCING BLOW-BY COKING

BACKGROUND

Embodiments described herein relate generally to ventilation of a combustion engine. More specifically, embodiments described herein relate to reduction of blow-by gas coking in a closed ventilation system of a combustion engine.

During operation of a combustion engine, gas is pressed out of the combustion chamber and into a crankcase through a gap between a piston ring and a cylinder wall. Gas may also come from valve stem seals and turbocharger seals. This oil entrained gas is called blow-by gas. Unless removed from the crankcase, the blow-by gas increases the pressure inside the crankcase.

Conventionally, the blow-by gas may be vented from the crankcase with a crankcase ventilation system, also called a breather assembly. In an open ventilation system, the breather assembly vents to the atmosphere, however blow-by ventilation to the atmosphere is considered part of a vehicle's total emissions. For this reason, emission of the blow-by to the ambient is usually avoided.

Another conventionally known crankcase ventilation system is a closed breather assembly, where the blow-by gas may be vented back to the engine, for example by first being vented to a turbocharger compressor. Venting blow-by gas to the engine intake/turbocharger compressor inlet can potentially contaminate the air intake hardware of the engine/turbocharger compressor. Under high temperatures, the oil entrained in the blow-by gas can harden and stick to the engine/turbocharger compressor. The hardening and sticking process of the oil from the blow-by gas is known as coking.

Another known method of venting the blow-by gas is forcing the blow-by gas into the exhaust gas so that both emissions are treated by an aftertreatment system of the vehicle, for example either a diesel oxidation catalyst (DOC) and/or a diesel particulate filter (DPF). To inject the blow-by gas into the exhaust, the blow-by gas must be heated and compressed so that the blow-by gas can remain in a gas phase. Additionally, the entrained oil may deposit on the DOC and cover the active sites of the catalyst, which may lower the effectiveness of the aftertreatment system, for example by lowering levels of passive DPF regeneration and increasing the light-off temperatures needed for active DPF regeneration. Alternatively, the blow-by gas emissions may result in higher rates of ash accumulation at the DPF, which may require more frequent ash removal servicing.

SUMMARY OF THE INVENTION

A method of coking entrained oil from blow-by gas of an engine in a closed breather assembly includes the steps of transporting the blow-by gas from the engine to a mist separator, transporting the blow-by gas from the mist separator to a breather coking device, heating the breather coking device at least one of conductively and convectively with an exhaust manifold of the engine, coking out at least a portion of entrained oil from the blow-by gas and depositing the coked oil at the breather coking device, and transporting the blow-by gas from the breather coking device to one of a turbocharger compressor and an engine.

DETAILED DESCRIPTION

Figure 1:
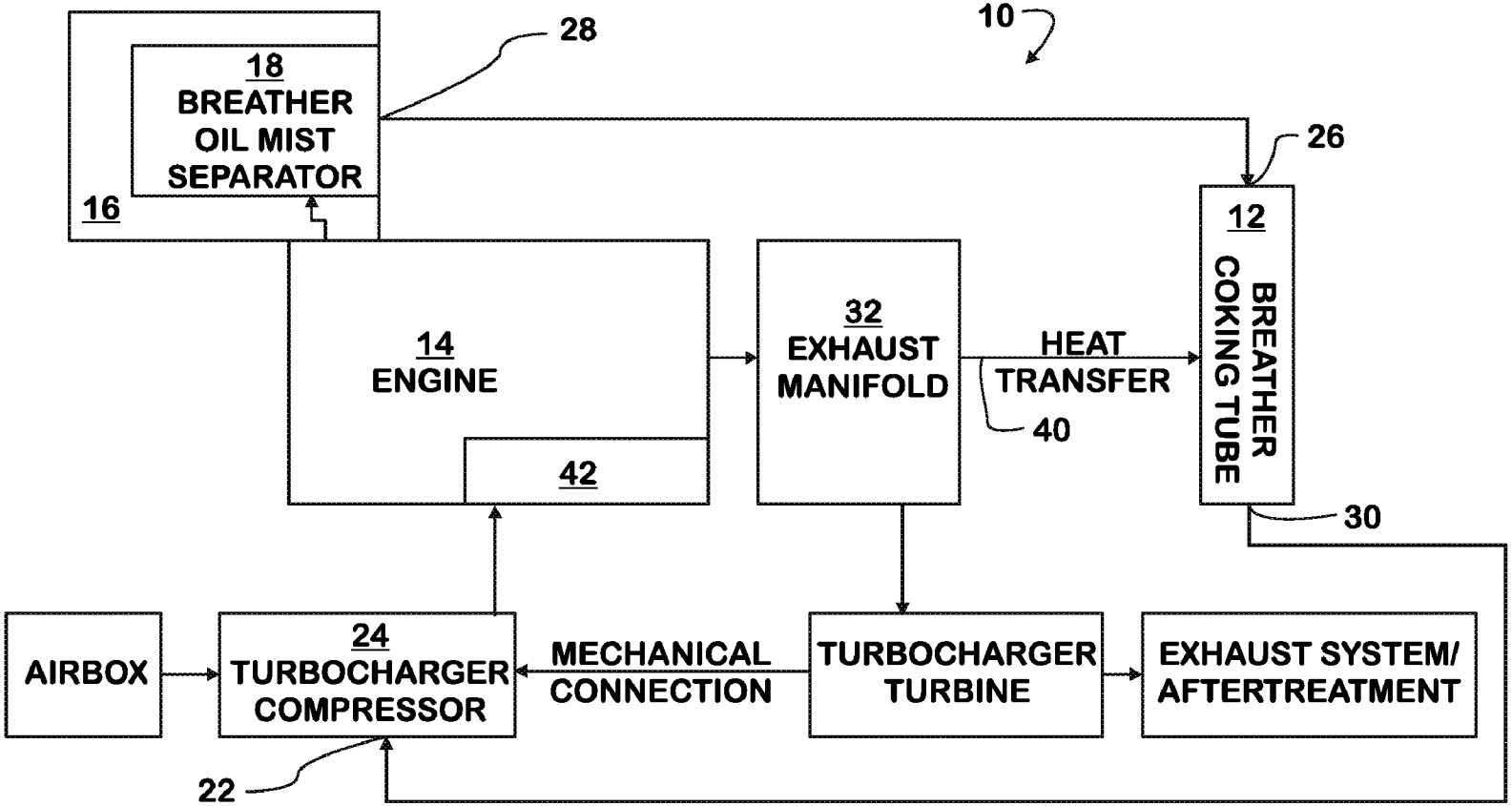
FIG. 1 is a flow-diagram of a blow-by treatment assembly having a breather coking device in fluid communication with a turbocharger compressor and an engine.
Figure 2:
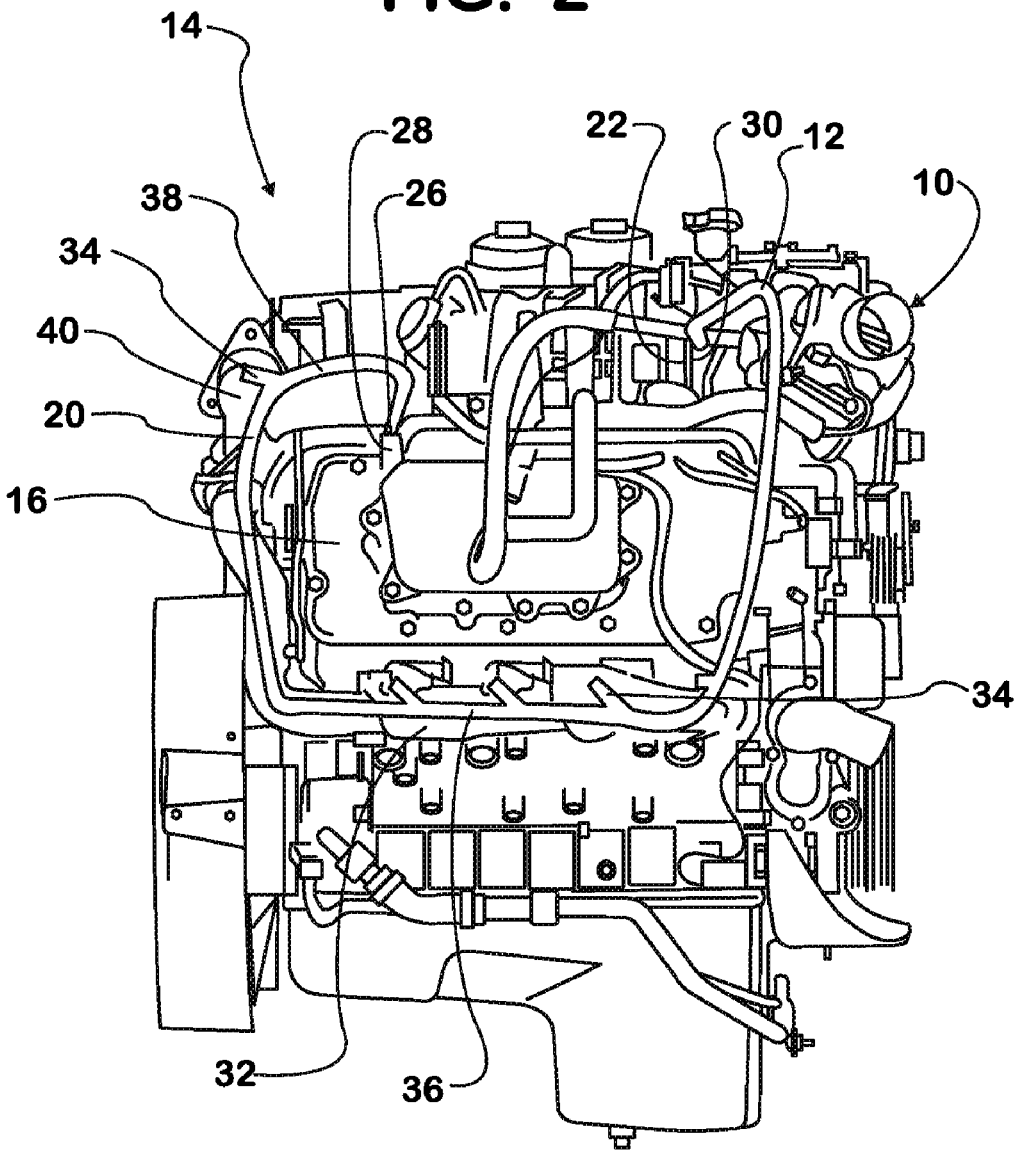
FIG. 2 is a side view of the engine and turbocharger compressor having a breather coking device in fluid communication between the engine and the turbocharger compressor.

Referring now to FIG. 1 and FIG. 2, a blow-by treatment assembly is indicated generally at 10 and includes a breather coking device 12 in downstream fluid communication with an engine 14. The engine 14 emits a flow of blow-by gas F from a breather assembly 16, which in the direction of flow of blow-by gas, is upstream from the breather coking device 12. The breather assembly 16 includes a breather oil mist separator 18, which may be located at or downstream of the engine 14. The mist separator 18 removes some, but not all, of the entrained oil hydrocarbons contained in the flow of blow-by gas F.

In the direction of flow of blow-by gas F, the mist separator 18 is arranged upstream of the breather coking device 12. In the blow-by treatment assembly 10, the breather coking device 12 has a tubular body 20 extending from the breather assembly 16 to an inlet 22 of a turbocharger compressor 24. While the breather coking device 12 has a tubular body 20, it is also possible that the breather coking device 12 has other shapes and configurations. For example, the breather coking device 12 may have a non-circular cross-section which would increase the interior surface area, and therefore increase the service interval of the coking device. Alternatively, the breather coking device 12 could be shaped to conform to the exhaust tubes and manifolds of the engine 14 so that the coking device 12 also forms a heat shield. The breather coking device 12 is formed of any heat resistant material, including metals such as stainless steel and carbon steel.

A coking inlet 26 of the breather coking device 12 is in downstream fluid communication with an outlet 28 of the breather assembly 16. The coking inlet 26 may be attached to the outlet 28. A coking outlet 30 of the breather coking device 12 is in upstream fluid communication with the inlet 22 of the turbocharger compressor 24, and may be attached to the inlet 22.

The breather coking device 12 is attached to the engine 14, including an exhaust manifold 32 of the engine 14, with mounts 34. At least a portion 36 of the breather coking device 12 may be oriented generally parallel to an exterior surface of the exhaust manifold 32. A second portion 38 of the breather coking device 12 is located in close proximity, for example less than 6-inches, to an exhaust tube 40 of the engine. Alternatively, the breather coking device 12 may contact the exhaust tube 40. It is possible that the breather coking device 12 may be less than 1-inch from the exhaust tube 40. It is also possible that any portion of the breather coking device 12 is located adjacent or contacting portions of the engine that emit large amounts of heat.

The breather coking device 12 is mounted to the engine 14 such that the coking device is either in contact with or in close proximity, for example less than 6-inches or less than 1-inch, to the exhaust manifold 32, which receives hot exhaust gases. The exhaust manifold 32 has a high temperature, typically in the range of 700-1400 degrees Fahrenheit, that via convection or conduction, transfers heat to the breather coking device 12. Additionally, the exhaust tube 40 may also transfer heat to the breather coking device 12. With the heat transfer from the exhaust manifold 32, the exhaust tube 40, and any other portion of the engine 14, the breather coking device 12 reaches a coking temperature, typically in the range of 300-350 degrees Fahrenheit.

When the blow-by gas F flows through the breather coking device 12, the high temperature of the coking device causes the entrained oil to coke out of the blow-by gas and deposit on the inside surface of the coking device 12. With the breather coking device 12 being located upstream of the turbocharger compressor 24, oil is coked-out of the blow-by gas F before the blow-by gas flows to the turbocharger compressor 24. In this configuration, the amount of coking at the turbocharger compressor 24 is reduced and/or eliminated.

It is also possible that, in the absence of a turbocharger compressor 24, that the breather coking device 12 may be in direct upstream fluid communication of an intake manifold 42 of the engine 14. In this configuration, the entrained oil in the blow-by gas F is coked out before reaching the intake manifold 42 of the engine 14.

When the breather coking device 12 experiences a large degree of coking, and the flow of blow-by gas F through the coking device 12 is impeded, the device may need to be replaced or cleaned. It is possible that the breather coking device 12 can be sized such that the device is effective throughout the life of the engine 14.

The blow-by treatment assembly 10 is an alternative to diverting the blow-by gas 18 directly to the air intake hardware of the engine/turbocharger compressor, where the intake hardware can become damaged by exposure to the blow-by gas. Further, the blow-by treatment assembly 10 is an alternative to emitting blow-by gas to the environment, or to combining the blow-by gas 18 with the exhaust gas and diverting it to the aftertreatment system of the vehicle. With the breather coking device 12, oil that is entrained in the blow-by gas F is coked out before reaching the inlet 22 of the turbocharger compressor 24, or alternatively, before reaching the intake manifold 42 of the engine 14. With most or substantially all of the oil coked out of the blow-by gas F before the gas reaches the turbocharger compressor 24 or the engine 14, there is little to no coking at the turbocharger compressor 24 or the engine 14.

What is claimed is:

1. A blow-by treatment assembly for a vehicle having an engine emitting blow-by gas, the blow-by treatment assembly comprising:

an exhaust manifold of the engine for receiving exhaust gas;

an oil mist separator in downstream fluid communication with the engine for receiving blow-by gas;

a breather coking device disposed in downstream fluid communication with the oil mist separator to receive blow-by gas, wherein at least a portion of the breather coking device receives heat transferred from the exhaust manifold to reach a coking temperature where entrained oil is coked out of the blow-by gas and deposited on the breather coking device;

a coking outlet of the breather coking device in upstream fluid communication with at least one of a turbocharger compressor and the engine;

an exhaust tube in fluid communication with the engine for receiving exhaust gases; and a second portion of the breather coking device receives heat transferred from the exhaust tube to reach a coking temperature where entrained oil is coked out of the blow-by gas and deposited in the breather coking device.

2. The blow-by treatment assembly of claim 1 wherein the breather coking device contacts the exhaust manifold to receive heat conductively transferred from the exhaust manifold.

3. The blow-by treatment assembly of claim 1 wherein the breather coking device is within about 6-inches of the exhaust manifold to receive heat convectively transferred from the exhaust manifold.

4. The blow-by treatment assembly of claim 1 wherein the coking temperature of the breather coking device is at least 300-degrees Fahrenheit.

5. The blow-by treatment assembly of claim 1 wherein the breather coking device comprises a tubular body.

6. The blow-by treatment assembly of claim 1 further comprising a coking inlet attached to a breather assembly, and a coking outlet attached to the turbocharger compressor.

7. The blow-by treatment assembly of claim 1 wherein the at least a portion of the breather coking device is oriented generally parallel to the exhaust manifold.

8. The blow-by treatment assembly of claim 1 wherein the breather coking device is mounted to the engine with mounts.

9. A blow-by treatment assembly for a vehicle having an engine emitting blow-by gas, the blow-by treatment assembly comprising:

an exhaust manifold of the engine for receiving exhaust gas;

an oil mist separator in downstream fluid communication with the engine for receiving blow-by gas;

a breather coking device having a tubular body attached to and in downstream fluid communication with the oil mist separator to receive blow-by gas, wherein at least a portion of the tubular body receives heat transferred from the exhaust manifold to reach a coking temperature where entrained oil is coked out of the blow-by gas and deposited on the breather coking device;

a coking outlet of the tubular body attached to and in upstream fluid communication with a turbocharger compressor;

an exhaust tube in fluid communication with the engine for receiving exhaust gases; and a second portion of the breather coking device receives heat transferred from the exhaust tube to reach a coking temperature where entrained oil is coked out of the blow-by gas and deposited in the breather coking device.

10. The blow-by treatment assembly of claim 9 wherein the breather coking device contacts the exhaust manifold to receive heat conductively transferred from the exhaust manifold.

11. The blow-by treatment assembly of claim 9 wherein the breather coking device is within 6-inches of the exhaust manifold to receive heat convectively transferred from the exhaust manifold.

12. The blow-by treatment assembly of claim 9 wherein the coking temperature of the breather coking device is at least 300 degrees Fahrenheit.

13. The blow-by treatment assembly of claim 9 wherein the at least a portion of the breather coking device is oriented generally parallel to the exhaust manifold.

* * * * *